US012790706B2

(12) United States Patent
Kishimoto et al.

(10) Patent No.: US 12,790,706 B2
(45) Date of Patent: Nov. 10, 2026

(54) PLATING SOLUTION CONTAINING SULFONIO GROUP-CONTAINING ETHER COMPOUND

(71) Applicant: JCU CORPORATION, Tokyo (JP)

(72) Inventors: Kazuki Kishimoto, Kawasaki (JP); Shota Higuchi, Kawasaki (JP)

(73) Assignee: JCU CORPORATION, Tokyo (JP)

( * ) Notice: Subject to any disclaimer, the term of this patent is extended or adjusted under 35 U.S.C. 154(b) by 0 days.

(21) Appl. No.: 18/842,532

(22) PCT Filed: Mar. 1, 2022

(86) PCT No.: PCT/JP2022/008580
§ 371 (c)(1),
(2) Date: Aug. 29, 2024

(87) PCT Pub. No.: WO2023/166552
PCT Pub. Date: Sep. 7, 2023

(65) Prior Publication Data
US 2025/0179676 A1 Jun. 5, 2025

(51) Int. Cl.
*C25D 3/02* (2006.01)
*C25D 3/38* (2006.01)

(52) U.S. Cl.
CPC ..... *C25D 3/38* (2013.01)

(58) Field of Classification Search
CPC ..... C25D 3/02; C25D 3/38
USPC ..... 205/261, 296
See application file for complete search history.

(56) References Cited

U.S. PATENT DOCUMENTS 3,000,799 A * 9/1961 Towle ..... C25D 3/12 205/277
4,388,450 A * 6/1983 Crivello ..... C08F 16/32 525/154
5,587,059 A * 12/1996 Yamoto ..... C09D 5/4457 523/415
2003/0085133 A1 5/2003 Totsuka et al.
2005/0070701 A1* 3/2005 Hochstetler ..... C12Q 1/04 536/26.26
2008/0314757 A1 12/2008 Nikolova et al.
2013/0043137 A1 2/2013 Yasuda et al.
2014/0005301 A1* 1/2014 Kunimoto ..... C07C 305/00 558/20
2018/0051384 A1* 2/2018 Nakaya ..... C25D 3/32

FOREIGN PATENT DOCUMENTS

JP 2003105584 A 4/2003
JP 2008231033 A 10/2008
JP 2016183410 A 10/2016
TW 201704546 A 2/2017
WO WO-03080896 A1 * 10/2003 ..... C25D 3/38
WO 2011135716 A1 11/2011

OTHER PUBLICATIONS

Zu Putlitz et al., "New Cationic Surfactants with Sulfonium Headgroups," Langmuir (Apr. 4, 2000), vol. 16, No. 7, pp. 3214-3220. ( Year: 2000).*
Alferiev et al., "High Reactivity of Alkyl Sulfides Towards Epoxides Under Conditions of Collagen Fixation—A Convenient Approach to 2-Amino-4-Butyrolactones," Biomaterials (Sep. 1, 2001), vol. 22, No. 18, pp. 2501-2506. (Year: 2001).*
Srogl et al., "Sulfonium Salts. Participants par Excellence in Metal-Catalyzed Carbon-Carbon Bond-Forming Reactions," Journal of the American Chemical Society (Dec. 17, 1997), vol. 119, No. 50, pp. 12376-12377. (Year: 1997).*
Ishibashi et al., "Synthesis of Ortho-Substituted Arylacetic Esters and Related Compounds by Means of Sommelet-Hauser Rearrangement of Sulfur Ylides," Chemical and Pharmaceutical Bulletin (Nov. 2, 19915), vol. 39, No. 11, pp. 2878-2882. (Year: 1991).*
Akhtar et al., "New Synthesis of Aryl-Substituted Sulfonium Salts and Their Applications in Photoinitiated Cationic Polymerization," Chemistry of Materials (Nov. 1, 1990), vol. 2, No. 6, pp. 732-737. (Year: 1990).*
Office Action issued on Aug. 4, 2023, in corresponding Taiwanese Application No. 111145030, 12 pages.
Extended Search Report issued on Jan. 28, 2026, in corresponding European Application No. 22929700.7, 7 pages.

* cited by examiner

*Primary Examiner* — Edna Wong
(74) *Attorney, Agent, or Firm* — Maier & Maier, PLLC

(57) ABSTRACT

A plating solution which has excellent via filling characteristics and is capable of forming a flat plating surface. This plating solution contains a water-soluble metal salt and a sulfonio group-containing ether compound. The metal salt can contain copper; and the sulfonio group-containing ether compound can have a mass average molecular weight of 2,000 to 10,000. In addition, the concentration of the sulfonio group-containing ether compound in the plating solution can be 0.1 mg/L to 1 g/L.

7 Claims, No Drawings

PLATING SOLUTION CONTAINING SULFONIO GROUP-CONTAINING ETHER COMPOUND

CROSS-REFERENCE TO RELATED APPLICATION

This application is the U.S. national stage of International Patent Application No. PCT/JP2022/008580, filed on Mar. 1, 2022, the disclosure of which is incorporated herein by reference in its entirety.

TECHNICAL FIELD

The present invention relates to a plating solution. More specifically, the present invention relates to a plating solution containing a sulfonio group-containing ether compound which has excellent via filling characteristics and is capable of forming a flat plating surface.

BACKGROUND

A technique for plating a base material with a metal is used in the field of electronic materials, and is applied to electronic devices such as liquid crystal displays and semiconductor devices. For example, plating treatment is frequently used as a technique for applying a metal to various portions of a semiconductor wafer and a printed electronic circuit such as a fine line circuit, for example. As the metal, copper having good electrical characteristics and allowing various processing methods is mainly used.

In manufacturing a printed wiring board, a gap between wires or a hole such as a via hole may be filled with a metal such as copper. In manufacturing a semiconductor wafer, filling with metal is also performed to minute vias, trenches, and the like formed on a wafer surface. In particular, in a board lamination method represented by a build-up method, so-called via filling plating, which fills a connection hole (hole) between layers, has been frequently used.

An electrolytic plating method is known as a metal filling technique represented by such via filling plating, and as the plating solution, for example, an acidic copper sulfate plating solution, an alkaline cyan-based or pyrophosphate-based copper plating solution, or the like is used. Among those, a plating solution containing a metal salt of a strong acid represented by copper sulfate is widely used from the viewpoint of facilitating solution management, electrodeposition rate control, and the like as compared to an alkaline plating solution.

In filling plating treatment, a plating solution having a composition containing, in addition to a metal salt, an organic compound called a leveler (leveling agent), as well as an acid, a surfactant, and the like is generally used. By containing the leveler, it is possible to control electrodeposition characteristics of the plating, to reliably fill a via, a trench, and a gap between wires, and to perform uniform plating treatment.

For example, Japanese Unexamined Patent Application, Publication No. 2003-105584 discloses a copper sulfate plating solution containing a polymer surfactant for preventing an electrodeposition reaction, a sulfur-based saturated organic compound such as dithiobisalkanesulfonic acid for accelerating an electrodeposition rate, and a leveler composed of a polymer amine compound. Japanese Unexamined Patent Application, Publication No. 2016-183410 discloses a tin plating solution using a sulfonium compound having a phenyl group or the like as a leveler and further containing a nonionic surfactant. PCT International Publication No. WO2011/135716 discloses, as a novel leveler, a tertiary amine compound obtained by causing a compound having a glycidyl ether group and a nitrogen-containing heterocyclic compound to react.

SUMMARY

In recent manufacture of printed wiring boards and semiconductor wafers, it is required to completely fill gaps by plating and realize flattening to a high degree. The plating solution disclosed in Japanese Unexamined Patent Application, Publication No. 2003-105584 has difficulty in achieving such high-level flattening. In the technique disclosed in Japanese Unexamined Patent Application, Publication No. 2016-183410, smoothness of a tin-plated surface is improved by adding a specific leveler, but the leveler hardly functions as a smoothing agent in a metal plating solution other than tin. Such a problem is solved by an amine-based leveler disclosed in PCT International Publication No. WO2011/135716, but further flattening of the plated surface is desired. Depending on applications, it is also required that the plating solution contains no nitrogen.

The present invention has been made in view of such circumstances, and an object of the present invention is to provide a plating solution which has excellent via filling characteristics and is capable of forming a flat plating surface.

The present inventors have found that a plating solution having excellent flattening performance can be obtained by containing a sulfonio group-containing ether compound as a leveler in the plating solution, and have completed the present invention.

(1) A first aspect of the present invention is a plating solution including: a water-soluble metal salt; and a sulfonio group-containing ether compound.

(2) A second aspect of the present invention is the plating solution as described in the first aspect, in which the sulfonio group-containing ether compound has a structure represented by Formula 1,

[Chem. 1]

(Formula 1)

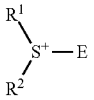

in which $R^1$ and $R^2$ each independently represent a substituted or unsubstituted aliphatic or aromatic hydrocarbon group, $R^1$ and $R^2$ may be bonded to each other to form a cyclic structure, and E represents an ether moiety in the sulfonio group-containing ether compound or a substituted or unsubstituted aliphatic or aromatic hydrocarbon group to which the ether moiety is bonded.

(3) A third aspect of the present invention is the plating solution as described in the second aspect, in which the sulfonio group-containing ether compound is a reaction product of an organic sulfur compound having groups represented by $R^1$ and $R^2$ and an ether compound having a reactive group.

(4) A fourth aspect of the present invention is the plating solution as described in any one of the first to third aspects, in which the sulfonio group-containing ether compound is a compound having a mass average molecular weight of 2,000 or more and 10,000 or less.

(5) A fifth aspect of the present invention is the plating solution as described in any one of the first to fourth aspects, in which the metal salt is a salt containing copper.

(6) A sixth aspect of the present invention is the plating solution as described in any one of the first to fifth aspects, in which the sulfonio group-containing ether compound is contained at a concentration of 0.1 mg/L to 1 g/L.

According to the present invention, it is possible to provide a plating solution which has excellent via filling characteristics and is capable of forming a flat plating surface. The plating solution of the present invention can be used to replace conventional levelers in applications where nitrogen-free plating solutions are required.

DETAILED DESCRIPTION OF THE EMBODIMENTS

Hereinafter, embodiments of the present invention will be described, but the embodiments are illustrated by way of example, and various modifications can be made without departing from the technical concept of the present invention.

<<1. Plating Solution>>

The plating solution of the present invention contains a water-soluble metal salt and a sulfonio group-containing ether compound.

[Composition of Plating Solution]

(1) Water-Soluble Metal Salt

The water-soluble metal salt constituting the plating solution of the present invention is not particularly limited, and examples thereof include water-soluble metal salts of copper (Cu), tin (Sn), titanium (Ti), chromium (Cr), manganese (Mn), iron (Fe), nickel (Ni), cobalt (Co), zinc (Zn), silver (Ag), gold (Au), platinum (Pt), palladium (Pd), indium (In), molybdenum (Mo), tungsten (W), lead (Pb), rhenium (Re), rhodium (Rh), ruthenium (Ru), osmium (Os), iridium (Ir), bismuth (Bi), aluminum (Al), and the like, as well as include water-soluble salts of semimetals such as germanium (Ge), arsenic (As), and antimony (Sb), and any salt used for plating. It is also possible to use a plurality of metal salts in combination as a plating solution for composite plating such as bronze plating or solder plating.

In the present invention, the "plating solution containing a water-soluble metal salt" includes all plating solutions in which a water-soluble metal salt can be widely detected in a liquid. That is, a plating solution in which the metal as described above is ionized and dissolved may be used, for example, a metal salt obtained by dissolving an insoluble metal oxide in an acid also corresponds to the "water-soluble metal salt" in the present invention. The plating solution of the present invention is preferably an aqueous solution of the metal salt, and may contain an organic solvent such as an alcohol including methanol, ethanol, and the like; an ether including tetrahydrofuran (THF), dioxane, various glymes, and the like; a carbonate ester including ethylene carbonate, propylene carbonate, dimethyl carbonate, diethyl carbonate, ethyl methyl carbonate, and the like; a nitrogen-containing solvent including acetonitrile, dimethylformamide (DMF), pyrrolidone, and the like; and a sulfur-containing solvent such as dimethyl sulfoxide (DMSO). Depending on a purpose and a metal salt to be used, an organic solvent may also be used as a main solvent.

A type of a counter ion to a metal in the water-soluble metal salt is also not particularly limited. Examples thereof include, but are not limited to, anions of inorganic acids such as hydrohalic acids including nitric acid, sulfuric acid, and hydrochloric acid, phosphoric acid, and oxoacids including chloric acid; and anions of organic acids such as alkanesulfonic acids including methanesulfonic acids and propanesulfonic acids, alkanol sulfonic acids including isethionic acid and propanolsulfonic acid, and aliphatic or aromatic carboxylic acids including citric acid, tartaric acid, and formic acid. The metal salt constituting the plating solution of the present invention may be a salt having a metal element in the anion, such as a molybdate or a chloroplatinate, and a counter anion in this case may be any ion such as an alkali metal ion or an ammonium ion. In addition, a plating solution for nickel-molybdenum alloy plating may be used in which a salt such as nickel molybdate is contained.

As described above, the plating solution of the present invention may contain any metal salt, but it is preferable that the plating solution contains a salt containing a metal such as copper, gold, nickel, or tin in consideration of use in the field of electronic materials. These metals are frequently used in manufacture of a printed wiring board or a semiconductor wafer, and a plating solution containing such a metal salt exhibits remarkable flattening performance according to the present invention. In particular, a copper salt such as copper sulfate or copper nitrate is preferable.

A concentration of the water-soluble metal salt in the plating solution of the present invention is not particularly limited, and can be optionally set according to the metal salt contained and an object to be plated. In general, in the plating in the field of electronic materials, a concentration of about 10 g/L to 80 g/L, particularly about 35 g/L to 75 g/L in terms of mass of metal ions is adopted, and the plating solution of the present invention can also have such an ion concentration.

Although the embodiment in which the metal oxide is dissolved in the acid has been described above, inclusion of the acid also has an advantage of facilitating plating solution management, electrodeposition rate control, and the like. Also in the present invention, the plating solution preferably contains an acid even in a case where a water-soluble metal salt is used as a raw material. The acid used here is not particularly limited, and a desired acid of the above-described inorganic acids and/or organic acids such as sulfuric acid and nitric acid can be used in accordance with a composition of the plating solution and the object to be plated. For example, in a case where the water-soluble metal salt is copper sulfate, the plating solution preferably contains sulfuric acid as the acid. A concentration of the acid is not limited, and may be set to, for example, about 5 g/L to 200 g/L, particularly about 10 g/L to 150 g/L.

(2) Sulfonio Group-Containing Ether Compound

The plating solution of the present invention contains a sulfonio group-containing ether compound in addition to the water-soluble metal salt described above. Accordingly, the via filling characteristics of the plating solution are improved, and a flat plating surface can be formed.

Here, the sulfonio group-containing ether compound is a compound having a sulfonio group ($R_3S^+$— group: R is a hydrogen atom or an organic group) and an ether bond (—O—), and is a type of an ether compound and at the same time a type of a sulfonium compound. The plating solution of the present invention may contain any compound as the sulfonio group-containing ether compound, and a type thereof is not particularly limited. A plurality of types of sulfonio group-containing ether compounds may be used in combination.

Among those, it is particularly preferable that the sulfonio group-containing ether compound contained in the plating solution has a structure represented by the following Formula 1. When the sulfonio group-containing ether compound has the structure of Formula 1, the plating solution of the present invention has further excellent flattening performance.

[Chem. 2]

(Formula 1)

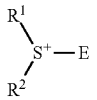

In the above-described Formula 1, $R^1$ and $R^2$ each independently represent a substituted or unsubstituted aliphatic or aromatic hydrocarbon group, and $R^1$ and $R^2$ may be bonded to each other to form a cyclic structure. Here, at least one of $R^1$ or $R^2$ is preferably an aliphatic hydrocarbon group, and more preferably an alkyl group, particularly an alkyl group having 1 to 3 carbon atoms. With such a structure, the plating solution of the present invention more easily exhibits the flattening performance. In addition, in a case where $R^1$ and $R^2$ are bonded to each other to form a cyclic structure, $R^1$ and $R^2$ are preferably bonded to each other to form, as an alkylene group, particularly an alkylene group having 3 to 7 carbon atoms, a 4-membered ring to 8-membered ring together with a sulfur atom. In a case where $R^1$ and/or $R^2$ is an aromatic hydrocarbon group, the hydrocarbon group is preferably a substituted or unsubstituted phenyl group. Here, a type, the number, and a position of a substituent on the aromatic hydrocarbon group such as a phenyl group and the aliphatic hydrocarbon group are not particularly limited. The flattening performance of the plating solution of the present invention is not impaired even in a case where the hydrocarbon group of $R^1$ and/or $R^2$, particularly the aromatic hydrocarbon group, has an electron-donating group such as an alkyl group or an alkoxy group, or has an electron-withdrawing group such as a halogen group or a halogenated hydrocarbon group.

In the above-described Formula 1, E represents an ether moiety in the sulfonio group-containing ether compound as described above or a substituted or unsubstituted aliphatic or aromatic hydrocarbon group to which the ether moiety is bonded. Here, the ether moiety may have one or more ether bonds (—O—), and a structure thereof is not particularly limited. Examples thereof may include various oxy groups such as an alkoxy group and a phenoxy group, an aliphatic or aromatic hydrocarbon group having such an oxy group as a substituent, a group having a plurality of ether bonds such as a polyoxyethynyl group, and an amino group, an amide group, and an acyl group having the above-described oxy group in a side chain. In addition, the aliphatic or aromatic hydrocarbon group having an oxy group as a substituent may be a relatively small group such as a methoxymethyl group, a methoxyethyl group, an ethoxyethyl group, a methoxypropyl group, and a methoxyphenyl group, or may be a group having a large formula weight such as a hydrocarbon group having a long-chain alkoxy group, and a long-chain alkyl group or a long chain alkenyl group having a methoxy group or an ethoxy group. The number of carbon atoms and the like in the polyoxyethynyl group is not particularly limited.

The above-described substituent E may have another sulfonio group at a terminal and/or a side chain. Here, the "another sulfonio group" may be the same as or different from the sulfonio group to which the substituent E is bonded. The number of sulfonio groups in the sulfonio group-containing ether compound is not particularly limited, but the plating solution can be provided with particularly excellent flattening performance by containing an ether compound having preferably 1 to 20, particularly preferably 2 to 10, sulfonio groups in the molecule.

In particular, the ether moiety of the sulfonio group-containing ether compound preferably has an alkylene oxide structure, for example, an ethylene oxide structure, and particularly a polyethylene oxide structure. Since a sulfonio group-containing ether compound having the alkylene oxide structure generally has good water solubility, it can be contained in a large amount in the plating solution. Therefore, the flattening performance of the plating solution can be further improved. An ether compound having the alkylene oxide structure can also be prepared relatively easily as described later. Specific examples of a sulfonio group-containing ether compound having a polyoxyalkylene structure include compounds represented by the following Formula 1-1.

[Chem. 3]

(Formula 1-1)

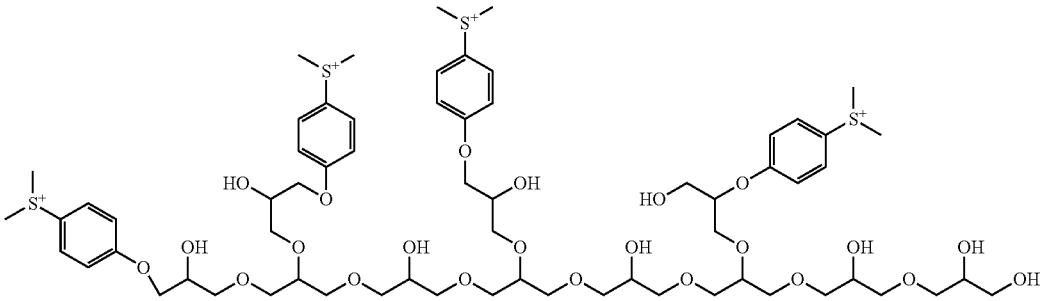

In the compound of Formula 1-1, groups corresponding to $R^1$ and $R^2$ in Formula 1 are all methyl groups, and a group corresponding to E is an aromatic hydrocarbon to which an ether moiety is bonded. Since aromatic sulfonyl compounds are generally more stable than aliphatic sulfonyl compounds, sulfur atom side sites of the substituents $R^1$, $R^2$, and E are preferably substituted or unsubstituted aromatic hydrocarbon groups, particularly, substituted or unsubstituted phenyl groups also in the sulfonio group-containing ether compound used in the present invention. However, the sulfonio group-containing ether compound is not limited to such a structure.

As described above, the sulfonio group-containing ether compound may be a compound having a relatively long chain length and a relatively large molecular weight. The molecular weight of the sulfonio group-containing ether compound is not particularly limited, and a mass average molecular weight thereof is preferably 500 to 100,000, more preferably 1,000 to 15,000, and particularly preferably 2,000 to 10,000. As shown in Examples to be described later, the plating solution containing a sulfonio group-containing ether compound having such a molecular weight exhibits excellent flattening performance. In particular, the via filling performance generally tends to be better as the molecular weight of the sulfonio group-containing ether compound in the plating solution is larger, and the via filling performance is particularly better in a plating solution containing a sulfonio group-containing ether compound having a mass average molecular weight of 2,000 or more. In addition, since sufficient water solubility is also ensured when the mass average molecular weight of the sulfonio group-containing ether compound is about 10,000 or less, a larger amount of the sulfonio group-containing ether compound can be contained in the plating solution of the present invention, and the flattening performance can be further improved. The molecular weight of the sulfonio group-containing ether compound can be measured by, for example, gel permeation chromatography (GPC) using monodisperse polyethylene oxide or polyethylene glycol as a standard.

(Preparation of Sulfonio Group-Containing Ether Compound)

The sulfonio group-containing ether compound can be prepared by, for example, a reaction between an organic sulfur compound and an ether compound having a reactive group. In a preferred embodiment of the present invention, the sulfonio group-containing ether compound is a reaction product of an organic sulfur compound having groups represented by the above-described $R^1$ and $R^2$ and an ether compound having a reactive group.

Here, the reactive group on the ether compound is not particularly limited, and a desired group can be selected from various reactive groups such as an epoxy group, a sulfonyl group, a sulfonyloxy group, a carboxy group, and an amino group. Alternatively, a sulfonio group-containing ether compound may also be prepared by bonding an ether compound having an allyl group and a sulfonium compound having an allyl group with a peroxide or the like. Among those, the reactive group is preferably an epoxy group or a sulfonyloxy group, and particularly preferably an epoxy group, from the viewpoint that the reaction proceeds reliably and rapidly.

In a case where the reactive group is an epoxy group, for example, a sulfonio group-containing ether compound represented by Formula 1α1 and/or Formula 1α2 can be prepared by causing an organic sulfur compound represented by Formula 2α and an epoxy group-containing ether compound represented by Formula 3 to react in the presence of an acid such as methanesulfonic acid, as in the following reaction formula α.

[Chem. 4]

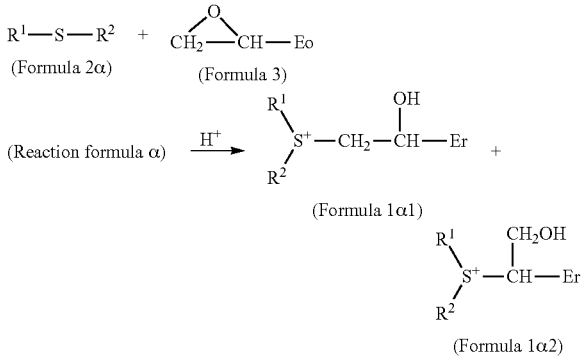

Here, $R^1$ and $R^2$ are the same as $R^1$ and $R^2$ in the above-described Formula 1, Eo and Er are groups containing an ether moiety; and —$CH_2$—CH(OH)—Er and the like are groups corresponding to -E in Formula 1, that is, the ether moiety in the sulfonio group-containing ether compound represented by Formula 1. Although the groups Er in Formulae 1α1 and 1α2 are represented by a different sign from that of the group Eo in Formula 3, this is because Eo itself may react and change to another group (for example, Eo further has epoxy groups and is polymerized using the epoxy groups as a starting point).

Alternatively, for example, a sulfonio group-containing ether compound represented by Formula 1β1 and/or Formula 1β2 can be prepared by causing a sulfonium compound having a hydroxy group represented by Formula 2β and an epoxy group-containing ether compound represented by Formula 3 to react in the presence of a catalyst such as potassium carbonate, as in the following reaction formula β.

[Chem. 5]

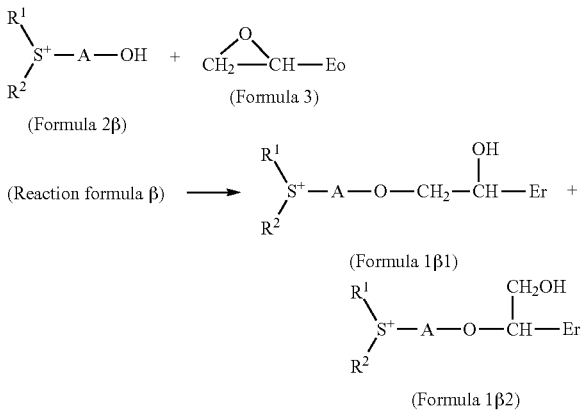

Here, $R^1$ and $R^2$ are the same as $R^1$ and $R^2$ in the above-described Formula 1, A is a substituted or unsubstituted aliphatic or aromatic divalent hydrocarbon group, Eo and Er are groups containing an ether moiety, and -A-O—$CH_2$—CH(OH)—Er and the like are groups corresponding to -E in Formula 1. The compounds represented by Formula 1β1 and Formula 1β2 correspond to compounds in which E is a substituted or unsubstituted aliphatic or aromatic hydrocarbon group to which an ether moiety is bonded in the sulfonio group-containing ether compound represented by Formula 1.

Also, in a case where the reactive group is a sulfonyloxy group, for example, a sulfonio group-containing ether compound represented by Formula 1γ may be prepared by causing a sulfonium compound having a hydroxy group represented by Formula 2β and an ether compound having a sulfonyloxy group represented by Formula 4 to react in the presence of a catalyst such as potassium carbonate, as in the following reaction formula γ.

(Reaction formula γ)

[Chem. 6]

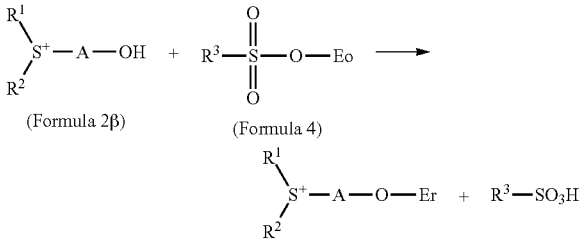

Here, $R^1$, $R^2$, A, as well as Eo and Er are the same as the substituents in the above-described reaction formula β, and $R^3$ is a substituted or unsubstituted aliphatic or aromatic hydrocarbon group, for example, a methyl group.

In the reaction represented by the reaction formula α, an acid other than methanesulfonic acid, for example, sulfuric acid, phosphoric acid, acetic acid, and the like may be used. Also, in the reactions represented by the reaction formulae β and γ, catalysts other than potassium carbonate, for example, sodium hydroxide, triethylamine, and the like can be used.

(2-1) Organic Sulfur Compound

The sulfonio group-containing ether compound can be prepared from any organic sulfur compound having substituents $R^1$ and $R^2$, and the above-described organic sulfur compound represented by Formula 2α and/or organic sulfur compound represented by Formula 2β are preferably used.

In the organic sulfur compounds represented by Formulae 2α and 2β, $R^1$ and $R^2$ each independently represent a substituted or unsubstituted aliphatic or aromatic hydrocarbon group, and $R^1$ and $R^2$ may be bonded to each other to form a cyclic structure. As described in the description of Formula 1, at least one of $R^1$ or $R^2$ is preferably an aliphatic hydrocarbon group, more preferably an alkyl group, and particularly an alkyl group having 1 to 3 carbon atoms. In addition, in a case where $R^1$ and $R^2$ are bonded to each other, $R^1$ and $R^2$ preferably form a 4-membered ring to 7-membered ring together with a sulfur atom. In a case where $R^1$ and/or $R^2$ is an aromatic hydrocarbon group, the hydrocarbon group is preferably a substituted or unsubstituted phenyl group.

In the organic sulfur compound represented by Formula 2β, A may be a substituted or unsubstituted aliphatic or aromatic divalent hydrocarbon group, preferably a substituted or unsubstituted aromatic hydrocarbon group, and more preferably a substituted or unsubstituted phenylene group. An organic sulfur compound having a phenolic hydroxy group easily reacts with a reactive group such as an epoxy group or a sulfonyloxy group in the ether compound. In particular, a -A-OH group is preferably a p-hydroxyphenyl group.

In the organic sulfur compound represented by Formula 2β, $R^1$ and $R^2$ are preferably hydrocarbon groups having 1 to 6 carbon atoms, and more preferably alkyl groups having 1 to 3 carbon atoms. In particular, both $R^1$ and $R^2$ are preferably methyl groups. One of particularly preferred embodiments of the organic sulfur compound represented by Formula 2β is a compound represented by the following Formula 2-1. Of course, other organic sulfur compounds can also be preferably used.

[Chem. 7]

(Formula 2-1)

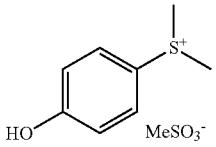

A counter anion of an organic sulfonium compound represented by Formula 2β is not particularly limited, and may be any type of anion such as an alkylsulfonate anion including a methylsulfonate anion, a borate anion including a tetrafluoroborate anion, a phosphate anion including a hexafluorophosphate anion, a sulfate anion, a nitrate anion, and a halide ion.

Particularly preferred embodiments of the organic sulfur compound represented by Formula 2α include, for example, compounds represented by the following Formulae 2-2 to 2-7.

[Chem. 8]

(Formula 2-2)

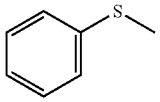

(Formula 2-3)

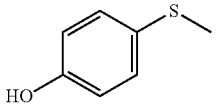

(Formula 2-4)

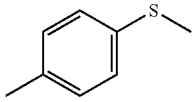

(Formula 2-5)

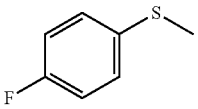

(Formula 2-6)

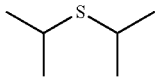

(Formula 2-7)

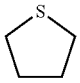

Of course, organic sulfur compounds other than those of Formulae 2-2 to 2-7 can also be preferably used. The compound represented by Formula 2-3 can also react with an ether compound through the hydroxy group (phenolic hydroxy group) in the molecule as in the reaction formula β.

(2-2) Ether Compound Having Reactive Group

The ether compound to be reacted with the organic sulfur compound may be any compound as long as it has a reactive group as described above, and preferably contains an epoxy group or a sulfonyloxy group as the reactive group. The ether compound represented by the above-described Formula 3 or 4 is more preferable. In particular, the substituents Eo in Formulae 3 and 4 preferably have an alkylene oxide structure, for example, an ethylene oxide structure, particularly a polyethylene oxide structure. The molecular weight thereof is also not particularly limited, and a mass average molecular weight thereof is preferably 50 to 10,000, more preferably 70 to 5,000, and particularly preferably 100 to 1,000.

The ether compound preferably has two or more epoxy groups in the molecule. When there are a plurality of epoxy groups, a polymerization reaction between ether compounds also proceeds during the reaction with the organic sulfur compound, and the sulfonio group-containing ether compound having a polyoxyalkylene structure can be produced. As a result, the obtained sulfonio group-containing ether compound has a high molecular weight and good water solubility at the same time, and the plating solution can be made more excellent in flattening performance.

Particularly preferred embodiments of the ether compound having a reactive group represented by Formula 3 include, for example, compounds represented by the following Formulae 3-1 to 3-4.

[Chem. 9]

(Formula 3-1)

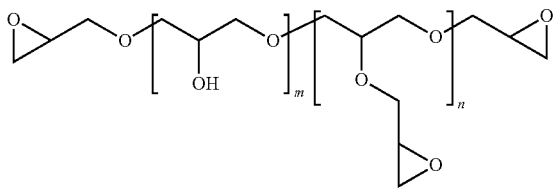

(Formula 3-2)

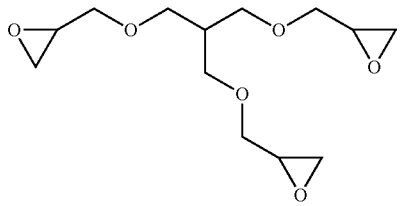

(Formula 3-3)

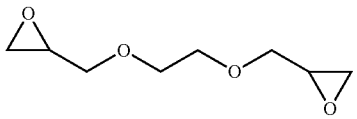

(Formula 3-4)

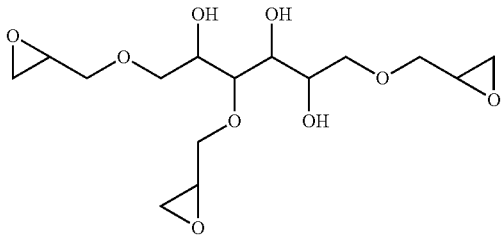

Of course, an epoxy group-containing ether compound other than those described above may be used as the compound of Formula 3. In Formula 3-1, m and n are each preferably an integer of 0 to 10, particularly preferably an integer of 1 to 6, and m+n is preferably 1 to 20, particularly preferably 2 to 10. A plurality of types of compounds represented by Formula 3-1 and the like may be used in combination. In this case, or in a case where the compounds represented by Formula 3-1 are polymerized with each other, an average value of m and n is not necessarily an integer, but such an embodiment is also included within the scope of the present invention.

A particularly preferred embodiment of the ether compound having a reactive group represented by Formula 4 includes, for example, a compound represented by the following Formula 4-1.

[Chem. 10]

(Formula 4-1)

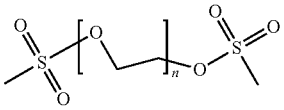

Of course, other sulfonyloxy group-containing ether compounds can also be preferably used. In Formula 4-1, n is preferably an integer of 1 to 10,000, and particularly an integer of 2 to 1,000. A plurality of types of compounds represented by Formula 4-1 and the like may be used in combination. In this case, an average value of n is not necessarily an integer, but such an embodiment is also included within the scope of the present invention.

A sulfonio group-containing ether compound can be synthesized by causing the ether compounds with the above-described organic sulfur compound to react. For example, the compound of the above-described Formula 1-1 can be prepared by causing the organic sulfur compound represented by Formula 2-1 and the ether compound represented by Formula 3-1 to react according to the reaction formula β. A molar ratio of the organic sulfur compound to the reactive group in the ether compound in the reaction does not necessarily need to be about 1:1, but can, for example, be about 1:0.9 to 1:1.1. It is also possible to polymerize the ether compounds by setting an equivalence ratio of the reactive group in the ether compound to the organic sulfur compound to, for example, 1:0.1 to 1:0.9, particularly 1:0.2 to 1:0.8 or the like according to a structure and a molecular weight of a desired sulfonio group-containing ether compound.

(Content of Sulfonio Group-Containing Ether Compound)

In the plating solution of the present invention, a content of the sulfonio group-containing ether compound is not particularly limited and may be optionally set depending on an object to be plated and a metal salt to be used. For example, the sulfonio group-containing ether compound can be contained at a concentration of about 0.1 mg/L to 1 g/L, more preferably about 1 mg/L to 700 mg/L, and particularly preferably about 1 mg/L to 500 mg/L. When the content of the sulfonio group-containing ether compound is about 0.1 mg/L or more, the plating solution exhibits good flattening performance, and when the content is about 1 g/L or less, the plating solution is advantageous in terms of cost.

(3) Additive

As described above, the plating solution of the present invention contains a water-soluble metal salt and a sulfonio group-containing ether compound. In addition, in order to facilitate plating solution management, electrodeposition rate control, and the like, an acid such as sulfuric acid as described above may be further contained as desired.

The plating solution of the present invention may contain, as desired, a halide ion, and further additives such as a brightening agent, a surfactant, a complexing agent, an antioxidant, a conductive salt, wetting agents, a phthalocyanine compound, and a dye including Janus green. Hereinafter, some of the additives will be described, but the additive that can be contained in the plating solution of the present invention is not limited thereto.

(Halide Ion)

Halide ions may be added to an ordinary acidic metal plating solution for the purpose of glossy metal plating or leveling. Also in the present invention, halide ions such as chlorine, bromine, and iodine may be added to the plating solution as necessary. In particular, chloride ions ($Cl^-$) are preferable. In this case, a concentration of the halide ions may be, for example, about 0.01 mg/L to 150 mg/L, preferably about 10 mg/L to 100 mg/L in terms of an ion mass concentration in the entire plating solution.

(Brightening Agent)

The brightening agent not only imparts gloss to a plating film, but also promotes deposition of a metal in recesses, and can contribute to flattening of the plating surface. A type of the brightening agent is not particularly limited, and examples thereof include benzaldehyde, o-chlorobenzaldehyde, 2,4,6-trichlorobenzaldehyde, m-chlorobenzaldehyde, p-nitrobenzaldehyde, p-hydroxybenzaldehyde, furfural, 1-naphthoaldehyde, 2-naphthoaldehyde, 2-hydroxy-1-naphthoaldehyde, 3-acenaphthoaldehyde, benzylideneacetone, pyrididene-acetone, furfuryldeneacetone, various aldehydes such as cinnamaldehyde, anisaldehyde, salicylaldehyde, crotonaldehyde, acrolein, glutaraldehyde, paraldehyde, and vanillin, triazine, imidazole, indole, quinoline, 2-vinylpyridine, aniline, phenanthroline, neocuproine, picolinic acid, thioureas, N-(3-hydroxybutylidene)-p-sulfanilic acid, N-butylidenesulfanilic acid, N-cinnamoylidenesulfanilic acid, 2,4-diamino-6-(2'-methylimidazolyl(1'))ethyl-1,3,5-triazine, 2,4-diamino-6-(2'-ethyl-4-methylimidazolyl(1'))ethyl-1,3,5-triazine, 2,4-diamino-6-(2'-undecylimidazolyl(1'))ethyl-1,3,5-triazine, phenyl salicylate, or, benzothiazoles such as benzothiazole, 2-mercaptobenzothiazole, 2-methylbenzothiazole, 2-aminobenzothiazole, 2-amino-6-methoxybenzothiazole, 2-methyl-5-chlorobenzothiazole, 2-hydroxybenzothiazole, 2-amino-6-methylbenzothiazole, 2-chlorobenzothiazole, 2,5-dimethylbenzothiazole, and 5-hydroxy-2-methylbenzothiazole, and sulfides such as bis(3-sodium sulfopropyl)disulfide. Among those, containing a sulfide-based compound as the brightening agent can further improve the flattening characteristics of the plating solution of the present invention. In particular, bis(3-sodium sulfopropyl)disulfide is preferable. In a case where a brightening agent is contained, a concentration thereof is preferably about 0.01 mg/L to 50 mg/L, and more preferably about 0.1 mg/L to 10 mg/L.

(Surfactant)

The surfactant is not particularly limited, and a desired surfactant can be selected from ordinary anionic surfactants, cationic surfactants, nonionic surfactants, amphoteric surfactants, and the like. In a case where a surfactant is contained, a concentration thereof is preferably about 10 mg/L to 50 g/L, and more preferably about 50 mg/L to 500 mg/L.

Examples of the anionic surfactant include polyoxyalkylene alkyl ether sulfate such as sodium polyoxyethylene nonyl ether sulfate, polyoxyalkylene alkyl phenyl ether sulfate such as sodium polyoxyethylene decylphenyl ether sulfate, alkylbenzene sulfonate such as sodium dodecylbenzene sulfonate, naphthol sulfonate such as sodium 1-naphthol-4-sulfonate and disodium 2-naphthol-3,6-disulfonate, (poly)alkyl naphthalenesulfonate such as sodium diisopropyl naphthalenesulfonate and sodium dibutyl naphthalenesulfonate, and alkyl sulfate such as sodium dodecyl sulfate and sodium oleyl sulfate.

Examples of the cationic surfactants include (mono- to tri-)alkylamine salts, dimethyldialkyl ammonium salts, trimethylalkyl ammonium salts, dodecyltrimethyl ammonium salts, hexadecyltrimethyl ammonium salts, octadecyltrimethyl ammonium salts, dodecyldimethyl ammonium salts, octadecenyl dimethyl ethyl ammonium salts, dodecyl dimethyl benzyl ammonium salts, hexadecyl dimethyl benzyl ammonium salts, octadecyl dimethyl benzyl ammonium salts, trimethyl benzyl ammonium salts, triethyl benzyl ammonium salts, hexadecyl pyridinium salts, dodecyl pyridinium salts, dodecyl picolinium salts, dodecyl imidazolinium salts, oleylimidazolinium salts, octadecylamine acetate, and dodecylamine acetate.

Examples of the nonionic surfactant include an addition condensate of a sugar ester, a fatty acid ester, an alkoxyl phosphoric acid (salt), a sorbitan ester, an aliphatic amide or the like with ethylene oxide and/or propylene oxide, a sulfated or sulfonated adduct of a condensate of a silicone polyoxyethylene ether, a silicone polyoxyethylene ester, a sulfated or sulfonated adduct of a condensate of a silicone polyoxyethylene ether, a silicone polyoxyethylene ester, a fluorine polyoxyethylene ether, a fluorine polyoxyethylene ester, and ethylene oxide and/or propylene oxide with an alkyl amine or diamine.

Examples of the amphoteric surfactant include betaine, carboxybetaine, imidazolinium betaine, sulfobetaine, and aminocarboxylic acid.

(Complexing Agent)

The complexing agent is an additive that can contribute to stabilization of metal ions in a plating solution and uniformity of a precipitated alloy composition in alloy plating. In particular, in a plating solution containing a noble metal such as silver, a complexing agent such as oxycarboxylic acid, polycarboxylic acid, or monocarboxylic acid is generally used. In a case where a complexing agent is contained, a concentration thereof may be, for example, about 0.1 g/L to 500 g/L, and particularly about 1 g/L to 100 g/L. Specific examples of the complexing agent include gluconic acid, citric acid, glucoheptonic acid, gluconolactone, glucoheptalactone, formic acid, acetic acid, propionic acid, butyric acid, ascorbic acid, oxalic acid, malonic acid, succinic acid, glycolic acid, malic acid, tartaric acid, diglycolic acid, thioglycolic acid, thiodiglycolic acid, thioglycol, thiodiglycol, mercaptosuccinic acid, 3,6-dithia-1,8-octanediol, 3,6,9-trithia-decan-1,11-disulfonic acid, thiobis-(dodecaethylene glycol), di(6-methylbenzothiazolyl)disulfide trisulfonic acid, di(6-chlorobenzothiazolyl)disulfide disulfonic acid, gluconic acid, citric acid, glucoheptonic acid, gluconolactone, glucoheptalactone, dithiodianiline, dipyridyl disulfide, mercaptosuccinic acid, a sulfite, a thiosulfate, ethylenediamine, ethylenediamine tetraacetic acid (EDTA), diethylenetriamine pentaacetic acid (DTPA), nitrilotriacetic acid (NTA), iminodiacetic acid (IDA), iminodipropionic acid (IDP), hydroxyethyl ethylenediaminetriacetic acid (HEDTA), triethylenetetraminehexaacetic acid (TTHA), ethylenedioxybis(ethylamine)-N,N,N',N'-tetraacetic acid, glycines, nitrilotrimethylphosphonic acid, or salts thereof. In addition, a sulfur-containing compound such as thioureas, tris(3-hydroxypropyl)phosphine, or the like may be contained.

(Antioxidant)

The antioxidant is used to prevent oxidation of a metal salt, and is important in a tin plating solution or the like. The antioxidant can be contained at a concentration of, for example, about 0.1 g/L to 500 g/L, and particularly about 1 g/L to 100 g/L. Examples of the antioxidant include hypophosphorous acids, ascorbic acid, phenolsulfonic acid, cresolsulfonic acid, hydroquinonesulfonic acid, hydroquinone, α- or β-naphthol, catechol, resorcin, phloroglucin, hydrazine, phenolsulfonic acid, catecholsulfonic acid, hydroxybenzenesulfonic acid, naphtholsulfonic acid, and salts thereof.

[Preparation of Plating Solution]

The plating solution of the present invention can be prepared from the above-described components by an ordinary method, and details thereof may be appropriately determined in consideration of a composition, a blending amount, and the like of each component.

<<2. Plating Treatment>>

As described above, by executing the plating treatment using the plating solution of the present invention, voids of a printed wiring board, a semiconductor wafer, or the like can be flattened, and a flat plating surface can be formed.

(Object to be Plated)

The plating solution of the present invention can be used for any object such as various boards and wafers. According to the plating solution of the present invention, a flat plating surface can be formed. The plating solution of the present invention is also excellent in uniform electrodeposition property, and can flatten voids of various sizes ranging from submicrometer to several hundreds of micrometers. Further, the plating solution of the present invention is also excellent in anisotropy, and is useful for plating of an electronic component and the like because mainly only a target portion can be plated. Examples of the electronic component include a printed circuit board, a flexible printed circuit board, a film carrier, a semiconductor integrated circuit, a resistor, a capacitor, a filter, an inductor, a thermistor, a quartz crystal unit, a switch, and a lead wire, but the object of the plating solution of the present invention is not limited thereto. The plating solution of the present invention can be applied on a part of the electronic component to form a film thereon, such as a bump electrode of a wafer.

Even in a case where a board is to be plated with the plating solution of the present invention, the board to be plated is not particularly limited. For example, a board made of a resin or the like on which a conductive layer made of a metal or the like is formed and patterned, a semiconductor substrate such as a silicon wafer or the like on which a fine circuit pattern is provided, a board for an electronic circuit such as a printed circuit board, or the like can be used as the object to be plated.

A blind via hole, a trench (groove) for fine wiring, a through hole penetrating a board, and the like may coexist in these boards. Since the plating solution of the present invention has excellent via filling characteristics, the plating solution is suitable for plating of a board having a via or a trench. The plating solution of the present invention can also be used for forming wiring of a board.

Specific examples of these boards include a printed circuit board such as a package substrate on which an IC bare chip is directly mounted, a silicon wafer on which an LSI or the like is directly mounted, and a silicon wafer substrate for manufacturing a semiconductor chip.

(Plating Operation)

The plating solution of the present invention can plate, for example, a board as described above by a normal plating operation. Hereinafter, an embodiment of the plating operation using the plating solution of the present invention will be described, but the present invention is not limited to such an embodiment.

For example, a board to be plated is subjected to pretreatment such as formation of a barrier layer as desired, and then subjected to conductive treatment such as formation of a metal seed layer serving as a power feeding layer on the board. The conductive treatment can be performed by an ordinary conductive treatment method, for example, metal (including carbon) coating treatment by electroless plating, a so-called direct plating treatment method using carbon, palladium, or the like, sputtering, vapor deposition, a chemical vapor deposition (CVD) method, or the like.

The board subjected to the conductive treatment is then plated with the plating solution of the present invention. Conditions in this case are not particularly limited, and may follow ordinary plating conditions. For example, the plating may be performed at a liquid temperature of about 20° C. to 30° C. and a cathode current density of about 0.05 A/dm$^2$ to 3 A/dm$^2$. In addition, a plating time may be appropriately set according to the purpose of plating. Further, in the plating, it is preferable to perform liquid stirring by aeration, pump circulation, paddle stirring, or the like.

According to the embodiment described above, the blind via hole, the through hole, the trench, a through-silicon via, and the like in the above-described board can be filled in a state where a surface layer plating thickness (a thickness of plating of a portion of the board where has no blind via hole, through hole, trench, and through-silicon via and the plating is performed simultaneously with the blind via hole, the through hole, the trench, and the through-silicon via) is thin.

Specifically, for example, in order to completely fill the via hole by executing plating on a patterned board having a blind via hole with a diameter of 50 μm and a depth of 30 μm, the plating can be performed at a cathode current density of 1.5 A/dm$^2$ for about 30 minutes. The surface layer plating thickness in this case may be, for example, about 10 μm.

In order to completely fill a via hole or a trench by executing plating on a board such as a silicon wafer having a via hole or a trench with a diameter of 0.1 μm to 0.5 μm and a depth of 0.2 μm to 1 μm for the purpose of manufacturing a semiconductor, the plating can be performed at a cathode current density of about 2 A/dm$^2$ for about 150 seconds. The surface layer plating thickness in this case is, for example, about 1 μm.

Further, for the purpose of three-dimensional mounting, for example, in order to perform filling plating on a through-silicon via having a diameter of 10 μm and a depth of 20 μm, the plating can be performed at a cathode current density of 2 A/dm$^2$ for about 10 minutes. The surface layer plating thickness in this case is, for example, about 5 μm. In addition, for example, in order to perform filling plating on a through-silicon via having a diameter of 20 μm and a depth of 100 μm, the plating can be performed at a cathode current density of 0.2 A/dm$^2$ for about 60 minutes. The surface layer plating thickness in this case is, for example, about 3 μm.

Operations and conditions in the plating method using the plating solution of the present invention are not limited to those described above, and the plating solution of the present invention can be applied to various plating processes or devices.

EXAMPLES

Hereinafter, the present invention will be described in more detail with reference to Examples, but the present invention is not limited to these descriptions.

Synthesis Examples 1 to 11

Prior to the preparation of the plating solution of the present invention, various sulfonio group-containing ether compounds were synthesized as follows. In the following Synthesis Examples, a structure of a product was analyzed by $^{1}$H-NMR or the like, and a mass average molecular weight was analyzed by GPC. GPC analysis was performed with a differential refractometer (RI) using monodisperse polyethylene oxide and polyethylene glycol as standard samples. In addition, NMR measurement was performed at 400 MHz.

Synthesis Example 1

In a reaction vessel, 2.87 g of polyglycerol polyglycidyl ether represented by Formula 3-1 (n+m=6), 5 g of pure water, 3.41 g of 4-hydroxyphenyldimethylsulfonium methanesulfonate represented by Formula 2-1 (amount of reaction group per epoxy group: 0.8 equivalent), and 1.76 g of potassium carbonate were placed in this order. After an internal temperature was increased to 70° C., a mixture thereof was stirred at 70° C.±5° C. for 3 hours. The reaction solution was returned to room temperature, and 4.34 g of 50% sulfuric acid was added to terminate the reaction. A total volume was adjusted to 40 mL with water to obtain an aqueous solution in which a concentration of a sulfonio group-containing ether compound (SE-1) was 157 g/L. SE-1 is presumed to have a structure represented by Formula 1-1. In $^{1}$H-NMR (solvent: heavy water), with the compound of Formula 2-1 as a raw material, a peak derived from a methyl group appearing at 3.08 ppm appeared as a broad peak at 3.21 ppm, and peaks derived from aromatic rings appearing near 6.7 ppm and 7.6 ppm appeared as broad peaks near 7.2 ppm to 7.3 ppm and 7.9 ppm, respectively. In addition, when measured by GPC, a mass average molecular weight of SE-1 was 7,800.

Synthesis Example 2

In a reaction vessel, 0.5 g of glycerol polyglycidyl ether (Formula 3-2), 1 g of pure water, 0.47 g of 4-hydroxyphenyldimethylsulfonium methanesulfonate (Formula 2-1) (amount of reaction group per epoxy group: 0.5 equivalent), and 0.24 g of potassium carbonate were placed in this order. After an internal temperature was increased to 70° C., a mixture thereof was stirred at 70° C.±5° C. for 3 hours. The reaction solution was returned to room temperature, and 1.57 g of 50% sulfuric acid was added to terminate the reaction. A total volume was adjusted to 20 mL with water to obtain an aqueous solution in which a concentration of a sulfonio group-containing ether compound (SE-2) was 49 g/L. It was confirmed by $^{1}$H-NMR that a sulfonio group different from the raw material was generated after the reaction. A mass average molecular weight of SE-2 was 4,120.

Synthesis Example 3

In a reaction vessel, 3.24 g of ethylene glycol diglycidyl ether (Formula 3-3), 3 g of pure water, 1.99 g of 4-hydroxyphenyldimethylsulfonium methanesulfonate (Formula 2-1) (amount of reaction group per epoxy group: 0.3 equivalent), and 1.03 g of potassium carbonate were placed in this order. After an internal temperature was increased to 70° C., a mixture thereof was stirred at 70° C.±5° C. for 3 hours. The reaction solution was returned to room temperature, and 3.9 g of 50% sulfuric acid was added to terminate the reaction. A total volume was adjusted to 40 mL with water to obtain an aqueous solution in which a concentration of a sulfonio group-containing ether compound (SE-3) was 131 g/L. It was confirmed by $^{1}$H-NMR that a sulfonio group different from the raw material was generated after the reaction. A mass average molecular weight of SE-3 was 2,710.

Synthesis Example 4

In a reaction vessel, 1.17 g of polyethylene glycol (molecular weight: 600) terminal methanesulfonylated product (Formula 4-1), 2 g of pure water, 1.04 g of 4-hydroxyphenyldimethylsulfonium methanesulfonate (Formula 2-1) (amount of reaction group per epoxy group: 1.0 equivalent), and 0.54 g of potassium carbonate were placed in this order. After an internal temperature was increased to 70° C., a mixture thereof was stirred at 70° C.±5° C. for 3 hours. The reaction solution was returned to room temperature, about 10 mL of pure water was added, and then 2.2 g of 50% sulfuric acid was added to terminate the reaction. A total volume was adjusted to 30 mL with water to obtain an aqueous solution in which a concentration of a sulfonio group-containing ether compound (SE-4) was 74 g/L. It was confirmed by $^{1}$H-NMR that a sulfonio group different from the raw material was generated after the reaction. A mass average molecular weight of SE-4 was 3,160.

Synthesis Example 5

In a reaction vessel, 0.95 g of polyglycerol polyglycidyl ether (Formula 3-1: n+m=6), 4 g of acetonitrile, 0.54 g of thioanisole (Formula 2-2) (amount of reaction group per epoxy group: 0.8 equivalent), and 0.52 g of methanesulfonic acid were placed in this order. After an internal temperature was increased to 80° C., a mixture thereof was stirred at 80° C.±5° C. for 4 hours. The reaction solution was returned to room temperature, and 5 g of pure water and 2.35 g of 50% sulfuric acid were added to terminate the reaction. A total volume was adjusted to 50 mL with water to obtain an aqueous solution in which a concentration of a sulfonio group-containing ether compound (SE-5) was 30 g/L. It was confirmed by NMR that SE-5 was a sulfonium compound. In $^{1}$H-NMR (solvent: DMSO-d6)), with the compound of Formula 2-2 as a raw material, a peak derived from an aromatic ring appearing in 7.27 ppm to 7.31 ppm appeared in 7.71 ppm to 8.09 ppm. A mass average molecular weight of SE-5 was 7,020.

Synthesis Example 6

In a reaction vessel, 1.39 g of sorbitol polyglycidyl ether (Formula 3-4), 4 g of acetonitrile, 0.81 g of thioanisole (Formula 2-2) (amount of reaction group per epoxy group: 0.8 equivalent), and 0.78 g of methanesulfonic acid were placed in this order. After an internal temperature was increased to 80° C., a mixture thereof was stirred at 80° C.±5° C. for 4 hours. The reaction solution was returned to room temperature, and 5 g of pure water and 2.35 g of 50% sulfuric acid were added to terminate the reaction. A total volume was adjusted to 50 mL with water to obtain an aqueous solution in which a concentration of a sulfonio group-containing ether compound (SE-6) was 44 g/L. It was confirmed by $^1$H-NMR that SE-6 was a sulfonium compound. A mass average molecular weight of SE-6 was 5,360.

Synthesis Example 7

In a reaction vessel, 0.88 g of polyglycerol polyglycidyl ether (Formula 3-1: n+m=6), 4 g of acetonitrile, 0.57 g of 4-(methylthio)phenol (Formula 2-3) (amount of reaction group per epoxy group: 0.8 equivalent), and 0.49 g of methanesulfonic acid were placed in this order. After an internal temperature was increased to 80° C., a mixture thereof was stirred at 80° C.±5° C. for 4 hours. The reaction solution was returned to room temperature, and 5 g of pure water and 2.35 g of 50% sulfuric acid were added to terminate the reaction. A total volume was adjusted to 50 mL with water to obtain an aqueous solution in which a concentration of a sulfonio group-containing ether compound (SE-7) was 29 g/L. It was confirmed by $^1$H-NMR that SE-7 was a sulfonium compound. A mass average molecular weight of SE-7 was 7,360.

Synthesis Example 8

In a reaction vessel, 2.01 g of polyglycerol polyglycidyl ether (Formula 3-1: n+m=6), 7 g of acetonitrile, 1.28 g of 4-(methylthio) toluene (Formula 2-4) (amount of reaction group per epoxy group: 0.8 equivalent), and 1.11 g of methanesulfonic acid were placed in this order. After an internal temperature was increased to 80° C., a mixture thereof was stirred at 80° C.±5° C. for 4 hours. The reaction solution was returned to room temperature, and 5 g of pure water and 2.35 g of 50% sulfuric acid were added to terminate the reaction. A total volume was adjusted to 250 mL with water to obtain an aqueous solution in which a concentration of a sulfonio group-containing ether compound (SE-8) was 14 g/L. It was confirmed by $^1$H-NMR that a sulfonio group was generated after the reaction. A mass average molecular weight of SE-8 was 6,360.

Synthesis Example 9

In a reaction vessel, 1.24 g of polyglycerol polyglycidyl ether (Formula 3-1: n+m=6), 5 g of acetonitrile, 0.81 g of 4-fluorothioanisole (Formula 2-5) (amount of reaction group per epoxy group: 0.8 equivalent), and 0.69 g of methanesulfonic acid were placed in this order. After an internal temperature was increased to 80° C., a mixture thereof was stirred at 80° C.±5° C. for 4 hours. The reaction solution was returned to room temperature, and 5 g of pure water and 2.35 g of 50% sulfuric acid were added to terminate the reaction. A total volume was adjusted to 100 mL with water to obtain an aqueous solution in which a concentration of a sulfonio group-containing ether compound (SE-9) was 21 g/L. It was confirmed by $^1$H-NMR that a sulfonio group was generated after the reaction. A mass average molecular weight of SE-9 was 6,520.

Synthesis Example 10

In a reaction vessel, 2.94 g of polyglycerol polyglycidyl ether (Formula 3-1: n+m=6), 11 g of acetonitrile, 2.00 g of isopropyl sulfide (Formula 2-6) (amount of reaction group per epoxy group: 0.8 equivalent), and 1.62 g of methanesulfonic acid were placed in this order. After an internal temperature was increased to 80° C., a mixture thereof was stirred at 80° C.±5° C. for 4 hours. The reaction solution was returned to room temperature, and 5 g of pure water and 2.35 g of 50% sulfuric acid were added to terminate the reaction. A total volume was adjusted to 70 mL with water to obtain an aqueous solution in which a concentration of a sulfonio group-containing ether compound (SE-10) was 71 g/L. It was confirmed by NMR that SE-10 was a sulfonium compound. In $^1$H-NMR (solvent: DMSO-d6)), with the compound of Formula 2-6 as a raw material, a peak derived from a methyl group appearing in 1.18 ppm to 1.20 ppm appeared in 1.45 ppm to 1.48 ppm. A mass average molecular weight of SE-10 was 6,450.

Synthesis Example 11

In a reaction vessel, 2.98 g of polyglycerol polyglycidyl ether (Formula 3-1: n+m=6), 11 g of acetonitrile, 1.21 g of tetrahydrothiophene (Formula 2-7) (amount of reaction group per epoxy group: 0.8 equivalent), and 1.64 g of methanesulfonic acid were placed in this order. After an internal temperature was increased to 80° C., a mixture thereof was stirred at 80° C.±5° C. for 4 hours. The reaction solution was returned to room temperature, and 5 g of pure water and 2.35 g of 50% sulfuric acid were added to terminate the reaction. A total volume was adjusted to 40 mL with water to obtain an aqueous solution in which a concentration of a sulfonio group-containing ether compound (SE-11) was 105 g/L. It was confirmed by $^1$H-NMR that a sulfonio group was generated after the reaction. A mass average molecular weight of SE-11 was 7,460.

Examples 1 to 11

(Preparation of Copper Sulfate Plating Solution)

Using each of the sulfonio group-containing ether compounds SE-1 to SE-11 obtained in Synthesis Examples 1 to 11 as a leveler of a plating solution, a copper sulfate plating solution having the following composition according to the present invention was prepared.

<Composition of Copper Sulfate Plating Solution>

- Copper sulfate pentahydrate: 200 g/L (concentration of $Cu^{2+}$: 50 g/L)
- Sulfuric acid: 100 g/L
- Chloride ion: 40 mg/L (concentration of $Cl^-$, added as hydrochloric acid)
- Polyethylene glycol (molecular weight: 6,000) (surfactant): 500 mg/L
- Bis-(3-sodium sulfopropyl)disulfide (brightening agent): 1 mg/L (2 mg/L only in Example 7)
- SE-1 to SE-11 (leveler): concentrations thereof are described in Table 1 below.

(Copper Sulfate Plating)

A resin substrate having a blind via hole with an opening diameter φ of 120 μm and a depth of 75 μm subjected to electroless copper plating was placed into each of the above-described copper sulfate plating solutions, and the copper sulfate plating was performed under the following conditions.

<Conditions of Copper Sulfate Plating>

- Current density: 1.5 A/dm$^2$
- Time: 45 minutes
- Bath volume: 500 mL
- Stirring: aeration, 1.5 L/min (Evaluation of Via Filling Performance)

A recess amount of each board after the above-described plating was measured, and the via filling performance was evaluated. Evaluation results are shown in Table 1 below together with a composition of each plating solution.

Comparative Examples 1 to 3

The via filling performance was evaluated in the same manner as in Examples 1 to 11 except that the following compounds were used as levelers. Evaluation results are shown in Table 1 below together with a composition of each plating solution.

Comparative Examples 1 and 2: 4-hydroxyphenyldimethylsulfonium methanesulfonate (Formula 2-1)

Comparative Example 3: Janus green (JGB: a compound having the following structure which is generally used as a leveler of the copper sulfate plating)

[Chem. 11]

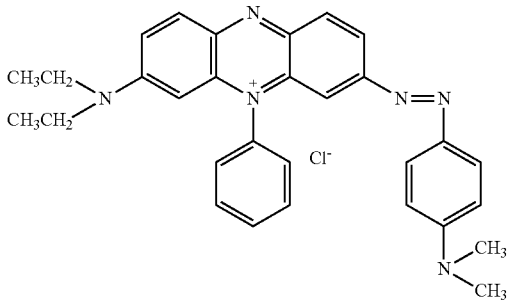

TABLE 1

[Table 1 Leveler used in each example and evaluation results]

| | Type of leveler* | | | | Concentration | |
|---|---|---|---|---|---|---|
| | Compound*1 | Sulfonio*2 | Ether*3 | Molecular weight | of leveler (mg/L) | Recess (μm) |
| Example 1 | SE-1 | Formula 2-1 | Formula 3-1 | 7800 | 15 | 21 |
| Example 2 | SE-2 | Formula 2-1 | Formula 3-2 | 4120 | 300 | 5 |
| Example 3 | SE-3 | Formula 2-1 | Formula 3-3 | 2710 | 300 | 0 |
| Example 4 | SE-4 | Formula 2-1 | Formula 4-1 | 3160 | 300 | 16 |
| Example 5 | SE-5 | Formula 2-2 | Formula 3-1 | 7020 | 5 | 8 |
| Example 6 | SE-6 | Formula 2-2 | Formula 3-4 | 5360 | 5 | 16 |
| Example 7 | SE-7 | Formula 2-3 | Formula 3-1 | 7360 | 1 | 16 |
| Example 8 | SE-8 | Formula 2-4 | Formula 3-1 | 6360 | 3 | 7 |
| Example 9 | SE-9 | Formula 2-5 | Formula 3-1 | 6520 | 5 | 8 |
| Example 10 | SE-10 | Formula 2-6 | Formula 3-1 | 6450 | 50 | 11 |
| Example 11 | SE-11 | Formula 2-7 | Formula 3-1 | 7460 | 20 | 21 |
| Comparative Example 1 | Sulfonium | Formula 2-1 | Not contained | 1360 | 15 | 75 |
| Comparative Example 2 | Sulfonium | Formula 2-1 | Not contained | 1360 | 300 | 75 |
| Comparative Example 3 | JGB | Not contained | Not contained | 511 | 4 | 22 |

*A symbol name (*1), a structure (*2, *3), and a molecular weight of a leveler used in each Example and Comparative Example

*1Sulfonio group-containing ether compounds were used in Examples 1 to 11, and sulfonium compounds were used in Comparative Examples 1 and 2.

*2A structure of the sulfonio group is represented by a formula of an organic sulfur compound used in preparation.

*3A structure of the ether moiety is represented by a formula of an ether compound used in the preparation.

As is clear from the results shown in Table 1, according to the present invention, the plating solution containing the water-soluble metal salt (copper sulfate) and the sulfonio group-containing ether compound was able to make the board after plating extremely flat. On the other hand, in Comparative Examples 1 and 2 using a sulfonium compound having no ether bond, recesses on the board were hardly filled even after plating. As shown in Comparative Example 2, even when a leveler concentration was increased, a flattening effect was not exhibited, and the importance of containing a sulfonio group-containing ether compound as a leveler was shown. In addition, all of the plating solutions of Examples 1 to 11 according to the present invention exhibited excellent flattening performance as compared to the plating solution of Comparative Example 3 containing JGB as a general leveler.

The invention claimed is:

1. A plating solution comprising: a water-soluble metal salt; and a sulfonio group-containing ether compound, wherein the plating solution is an aqueous solution, the metal salt is a salt containing copper, and the sulfonio group-containing ether compound has a structure represented by Formula 1,

[Chem. 1]

(Formula 1)

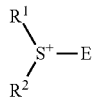

wherein $R^1$ and $R^2$ each independently represent a substituted or unsubstituted aliphatic or aromatic hydrocarbon group with a proviso that at least one of $R^1$ and $R^2$ is an aromatic hydrocarbon group or $R^1$ and $R^2$ are bonded to each other to form a cyclic structure; and E represents (i) an ether moiety in the sulfonio group-containing ether compound; or (ii) a substituted or unsubstituted aliphatic or aromatic hydrocarbon group to which an ether moiety in the sulfonio group-containing ether compound is bonded.

2. The plating solution according to claim 1, wherein the sulfonio group-containing ether compound is a reaction product of an organic sulfur compound having groups represented by $R^1$ and $R^2$ and an ether compound having a reactive group.

3. The plating solution according to claim 1, wherein the sulfonio group-containing ether compound is a compound having a mass average molecular weight of 2,000 or more and 10,000 or less.

4. The plating solution according to claim 1, wherein the sulfonio group-containing ether compound is contained at a concentration of 0.1 mg/L to 1 g/L.

5. A plating solution comprising: a water-soluble metal salt; and a sulfonio group-containing ether compound, wherein the plating solution is an aqueous solution, the sulfonio group-containing ether compound has a structure represented by Formula 1, and substituent E in the Formula 1 contains an ether moiety having a polyoxyalkylene structure,

[Chem. 1]

(Formula 1)

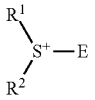

wherein $R^1$ and $R^2$ each independently represent a substituted or unsubstituted aliphatic or aromatic hydrocarbon group, $R^1$ and $R^2$ may be bonded to each other to form a cyclic structure; and E represents a substituted or unsubstituted phenylene group to which the ether moiety is bonded.

6. The plating solution according to claim 5, wherein the metal salt is a salt containing copper.

7. A plating solution comprising: a water-soluble metal salt; and a sulfonio group-containing ether compound, wherein the plating solution is an aqueous solution, the metal salt is a salt containing copper, the sulfonio group-containing ether compound has a structure represented by Formula 1, and substituent E in the Formula 1 contains an ether moiety having a polyoxyalkylene structure,

[Chem. 1]

(Formula 1)

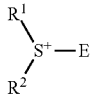

wherein $R^1$ and $R^2$ each independently represent a substituted or unsubstituted aromatic hydrocarbon group, an unsubstituted aliphatic hydrocarbon group, or an aliphatic hydrocarbon group substituted with an alkyl group, an alkoxy group, a halogen group, or a halogenated hydrocarbon group; $R^1$ and $R^2$ may be bonded to each other to form a cyclic structure; and E represents (i) the ether moiety; or (ii) a substituted or unsubstituted aliphatic or aromatic hydrocarbon group to which the ether moiety is bonded.

* * * * *